US006304281B1

(12) United States Patent
Weichmann et al.

(10) Patent No.: US 6,304,281 B1
(45) **Date of Patent: *Oct. 16, 2001**

(54) PROCESS AND DEVICE FOR PROVIDING THERMAL TRANSFER MATERIAL FOR THERMAL TRANSFER IMAGE GENERATION

(75) Inventors: Armin Weichmann, Kissing; Alfons Schuster; Michael Müller, both of Augsburg; Thomas Hartmann, Friedberg; Dirk Probian, Gablingen, all of (DE)

(73) Assignee: Man Roland Druckmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/267,737

(22) Filed: Mar. 15, 1999

(30) Foreign Application Priority Data

Mar. 13, 1998 (DE) ..... 198 11 030

(51) Int. Cl.[7] ..... B41J 33/14; B41J 33/00
(52) U.S. Cl. ..... 347/217; 347/176
(58) Field of Search ..... 347/188, 217, 347/215, 176; 406/208, 212, 73; 358/1–16; 400/206, 206.2

(56) References Cited

U.S. PATENT DOCUMENTS

| | | | | |
|---|---|---|---|---|
| 4,543,001 | * | 9/1985 | Tanaka et al. | 400/212 |
| 5,354,134 | * | 10/1994 | Patry | 400/73 |
| 5,365,312 | | 11/1994 | Hillmann et al. | 355/206 |
| 5,393,149 | | 2/1995 | Lima | 400/208 |
| 5,492,420 | | 2/1996 | Nunokawa et al. | 400/62 |
| 5,538,351 | | 7/1996 | Miyano | 400/206 |
| 5,690,439 | * | 11/1997 | Sasaki et al. | 347/176 |
| 5,774,639 | * | 6/1998 | Schildkraut et al. | 358/1.16 |
| 5,777,652 | | 7/1998 | Takeuchi | 347/171 |
| 5,803,627 | | 9/1998 | Paranjpe | 400/240 |
| 5,863,138 | * | 1/1999 | Watanabe et al. | 400/208 |
| 6,018,356 | * | 1/2000 | Morimura et al. | 347/215 |

FOREIGN PATENT DOCUMENTS

| | | | |
|---|---|---|---|
| 0 703 089 | 5/1995 | (EP) | B41J/35/28 |
| 0 860 292 | 1/1998 | (EP) | B41J/17/32 |
| 2 744 391 | 8/1997 | (FR) | B41J/2/175 |
| 2 314 042 | 12/1997 | (GB) | B41J/2/325 |
| 63-268675 | 7/1988 | (JP) | B41J/17/32 |
| 6-183119 | 12/1992 | (JP) | B41J/35/36 |
| 6-238926 | 2/1993 | (JP) | B41J/2/325 |
| 06183119 | 7/1994 | (JP) | B41J/35/36 |
| 6-238997 | 8/1994 | (JP) | B41J/32/00 |
| 8-101849 | 9/1994 | (JP) | B06F/17/30 |
| 8-310007 | 5/1995 | (JP) | B41J/2/175 |
| 7-304241 | 11/1995 | (JP) | B41J/35/22 |
| 11-58867 | 8/1997 | (JP) | B41J/17/32 |
| 9-226216 | 9/1997 | (JP) | B41J/35/22 |

* cited by examiner

*Primary Examiner*—N. Le
*Assistant Examiner*—K. Feggins
(74) *Attorney, Agent, or Firm*—Cohen, Pontani, Lieberman & Pavane

(57) ABSTRACT

To optimize the provision of thermal transfer material and to correctly provide different thermal transfer materials for the respective purpose at the correct time, a plurality of thermal transfer ribbons are made available, each in its own cassette. A control device provides management and controlling mechanism for managing the plurality of cassettes that are stored in a storage device.

12 Claims, 4 Drawing Sheets

PROCESS AND DEVICE FOR PROVIDING THERMAL TRANSFER MATERIAL FOR THERMAL TRANSFER IMAGE GENERATION

BACKGROUND OF THE INVENTION

1. Field of the Invention

The invention relates to the process of thermal transfer printing, especially multicolored printing forms or offset printing forms, using a narrow ribbon as transfer film. More specifically, the invention relates to a process of thermal transfer printing which optimizes the provision of thermal transfer material and correctly makes available different materials for the respective purpose at the correct time.

2. Description of the Related Art

The process of thermal transfer has been known for years. In principle, a substrate which may be the final substrate or an intermediate substrate is brought into contact with an ink film arranged on a carrier and the ink film is transferred by thermal action to the substrate in points or dots to form the image on the substrate.

Several colors may also be applied successively by using different colored films so that color printing can be realized in his way. If the substrate is an intermediate substrate, the finished multicolored image is then transferred in a further step to the target substrate. Further, a printing form may also be coated to form an image by a suitable polymer. For example, if the printing form base is hydrophilic and therefore does not accept ink, the image-carrying parts are transferred to this printing form as a positive by thermal transfer and are then hydrophobic, that is, ink-accepting.

A prior art process for printing via thermal transfer is disclosed in German Patent DE 44 30 555. In this process, the thermal transfer film is constructed as a narrow ribbon. The problem in this method consists in that the thermal transfer ribbon must be changed after every generated image or after a few generated images. Further, this reference does not indicate how thermal transfer ribbons composed of different materials can be used electively for different requirements, which would be desirable.

SUMMARY OF THE INVENTION

It is the object of the invention to provide a process for thermal transfer printing and a device such that a transfer ribbon can be made available in a simple manner and that this availability can be ensured in a simple manner for a plurality of generated images.

It is a further object of the invention to provide a process for thermal transfer printing and a device such that each one of a plurality of different materials is accessible at any time for thermal transfer ribbons as is necessary, for example, in multicolor printing.

This object is met by a device for thermal transfer imaging, including a thermal imaging unit comprising means for effecting thermal transfer imaging, a storage device comprising a plurality of cassettes, each said plural cassettes having a thermal transfer ribbon and an information module containing data pertaining to one of identification and status of said thermal transfer ribbon, a cassette receiving device operatively connected for moving a selected on of said plural cassettes into alignment with said thermal imaging unit, and a control device for managing said plural cassettes, said storage device, and said cassette receiving device in response to an externally supplied illustration command.

This object is also met by a process for providing a thermal transfer material for thermal transfer image generation using a narrow thermal transfer ribbon, including the steps of loading a plurality of cassettes in a storage device such that each cassette is available for use in a thermal image generation arrangement, each cassette containing a thermal transfer ribbon and an information module containing information pertaining to one of identification and status of the thermal transfer ribbon therein; and managing the plural cassettes with a control device by reading the information module of the cassettes.

The thermal transfer ribbon comes packaged in a cartridge or cassette. A master control device manages and controls a large number of cassettes in conjunction with data related to the requirements for the type of thermal transfer ribbon. The type of thermal transfer ribbon to be used depends on the intended use. The control device accesses a storage means in which the large number of cassettes are stored and accessible. The control system may comprise, for example, a software program.

The management of the fabricated cassettes may be accomplished using bar codes arranged at each respective cassette. In the alternative, an electronic chip may be added to the respective cassette. The control device may be a master control device or a decentralized type control device.

For example, a master control device can work over the Internet. In this embodiment, information read from the bar code on a cassette can be matched to information from a manufacturer database for thermal transfer ribbons/cassettes so that the cassette is automatically identified. Information about the status of the operating resources, the amount of ink film left on the thermal transfer ribbon (empty or full), the degree of wear, and the suitability of the film material for the respective use such, for example, as printing on different substrates such as paper, anodized aluminum, PET foils (e.g., with erasable waterless offset) may also be obtained automatically for every thermal transfer ribbon.

The internet connection enables a master control/regulation on the part of the manufacturer of thermal transfer ribbons, since all user data (for example, shelf life/expiration date) are available from that source and can be called up by the manufacturer.

The cassettes may also include an added electronic chip which may be written to and therefore may be updated every time an image is generated. When the electronic chip is used, the master control device is not absolutely necessary. In this embodiment, the control device could also be designed so as to be decentralized. One control device per printer would be sufficient for managing the self-identification of the thermal transfer ribbon cassettes.

The identification of the thermal transfer ribbons made available in a cassette may also be carried out in a noncontacting maimer. For example, electromagnetic transmission (microwaves, IR, light, etc.) is possible, e.g., as is already known for ski lift ID cards.

The thermal transfer ribbons may have the following different characteristics which are indicated on the identification portion of the cassette: different colors in the event that a multicolor print is produced (e.g., cyan, magenta, yellow and black, one after the other), different polymer chemistry for the use of the printing form in different areas of printing (e.g., ribbon for short runs with subsequent simple removal of the image for reusing or ribbon for long runs without the possibility of reusing or with a long duration for producing reusability), and different ink systems (e.g., petroleum-oil inks or UV-curable inks).

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
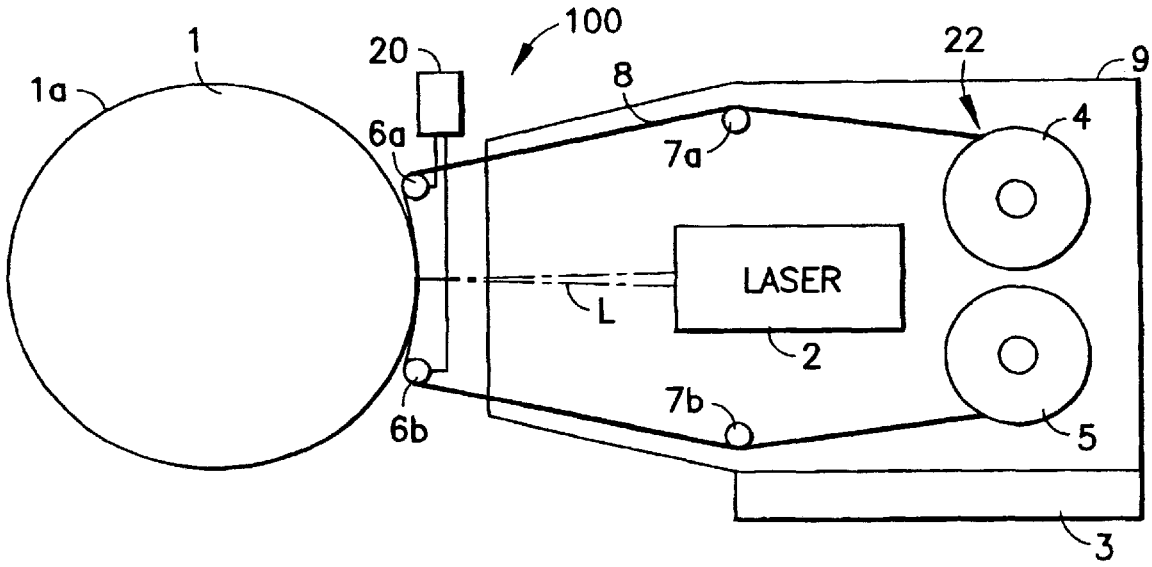
FIG. 1 shows a side view of a device for thermal transfer for carrying out the thermal transfer process with a ribbon guiding mechanism according to an embodiment of the present invention.
Figure 2:
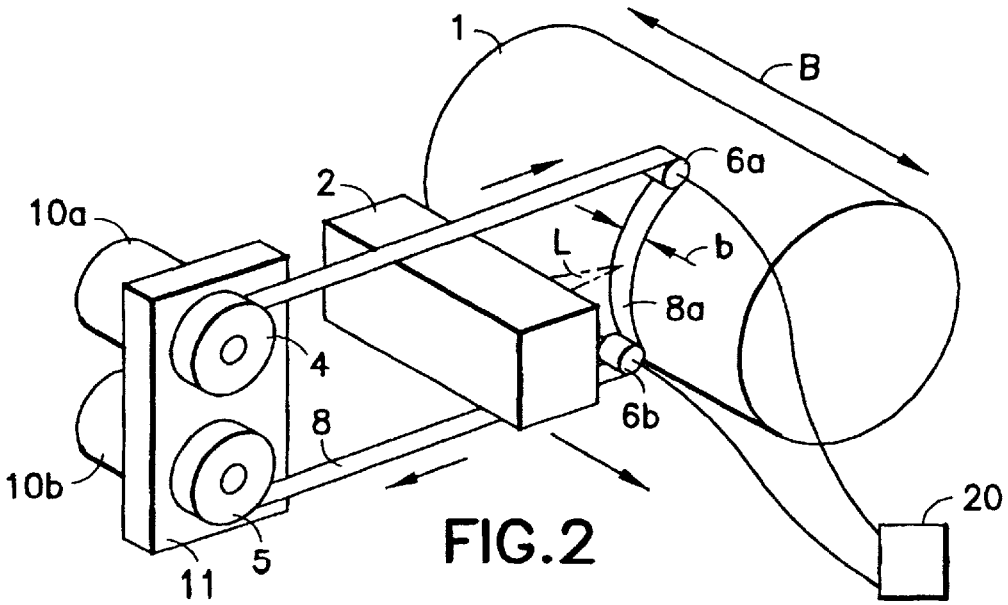
FIG. 2 is a perspective view of the device for carrying out the thermal transfer process showing the functional components within the cassette.

Referring to FIGS. 1 and 2, a device 100 for thermal transfer imaging includes a substrate 1*a* mounted on an outer surface of a substrate cylinder 1. A ribbon transport mechanism 22 includes a supply roll 4 and a take up roll 5, two adjusting rollers 6*a*, 6*b* and two guide rollers 7*a*, 7*b* for guiding a ribbon-shaped thermal transfer film (thermal transfer ribbon 8) in proximity to the substrate cylinder 1. The thermal transfer ribbon 8 may also be guided such that it contacts the substrate la. The portions of the supply roll 4 and the take up roll 5 may be switched so that the transfer ribbon 8 is guided in the reverse direction. A thermal imaging unit 2, such for example, as a laser writing head focuses one or more light beams onto the transfer ribbon 8.

In the preferred embodiment, a traversing unit 3 is connected to the thermal imaging unit 2 and the ribbon guide mechanism 22 for moving over the width B of the substrate cylinder 1. A cassette 9 is used for accommodating at least the take up roll 5 and the supply roll 4. As shown in FIG. 1, the cassette 9 may also accommodate the two guide rollers 7*a*, 7*b*.

FIG. 2 shows winding motors 10*a*, 10*b* which are operatively respectively connected to the supply roll 4 and the takeup roll 5. A base plate 11 rotatably hold the winding motors 10*a*, 10*b* and the supply roll 4 and the takeup roll 5. The deflecting rollers 6*a*, 6*b* are driven by a suitable means 20 for pulling the transfer ribbon 8 out of the cassette 9 and making a portion 8*a* of the transfer ribbon 8 between the deflecting rollers 6*a*, 6*b* available for thermal imaging on the substrate 1.

Figure 3:
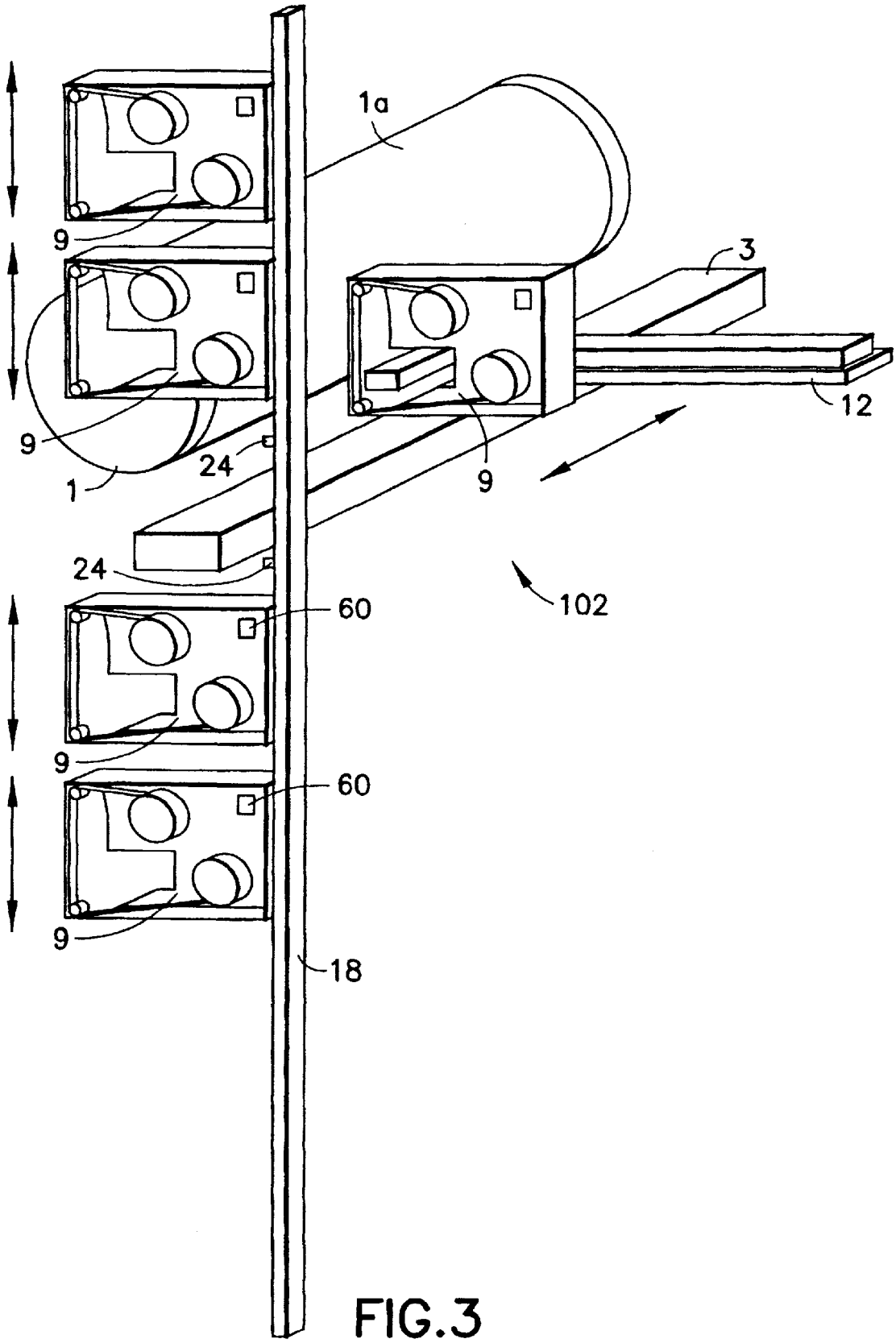
FIG. 3 is a general view of the arrangement with a device for carrying out the thermal transfer process using a cassette together with a storage for cassettes according to an embodiment the invention.

Referring now to FIG. 3, an arrangement 102 for performing the process according to the invention shows a storage device 18 which holds a plurality of cassettes 9, each of which have different characteristics such as different colors, different polymer, chemistries, and different ink systems. A cassette receiving station 12 is mounted on the traversing unit 3 and is movable by the traversing unit to the storage device 18. A cassette 9 which is already mounted on the receiving station 12 can be inserted back into the storage device 18, where it is held by a gripping mechanism 24. Conversely, a cassette 9 in the storage device 18 may be positioned alongside the receiving station 12 and transferred to the receiving station 12.

Figure 5:
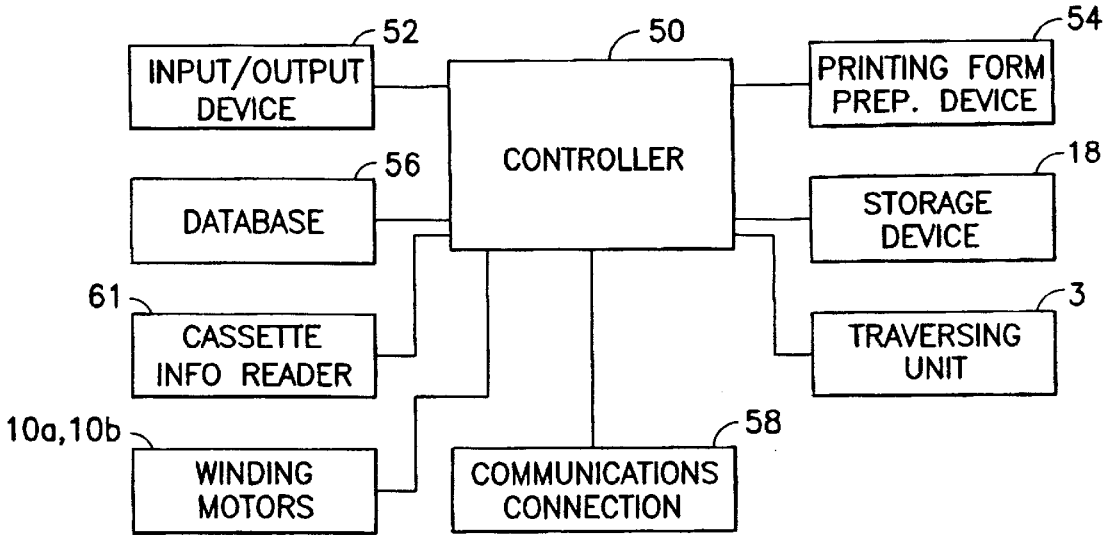
FIG. 5 is a description of a thermal imaging illustration cycle using the arrangement according to an embodiment of the invention.

Referring to FIG. 5, the following is a description of a thermal imaging illustration cycle using the arrangement 102. A controller 50 receives an illustration command via an input/output device 52. The control 50 initiates the preparation of a printing form in response to receiving the illustration command via a printing form preparation device 54. The printing form may comprise a pre-anodized aluminum plate as substrate 1*a* stretched on substrate cylinder 1. The processes for preparing a printing form are known from relevant publications pertaining to image generation on plates. After preparation of the printing form, the controller 50 searches its database 56 to determine whether a suitable transfer ribbon is present in the storage device 18. The database is maintained by the controller 50 by reading information 60 (FIG. 3) from the selected cassette via a cassette information reader 61 when the cassette is put into the storage device 18. The information 60 (see FIG. 3) on each cassette 9 may include a bar code, or an electronic chip on the cassette. If an electronic chip is used, the information can be updated. Further information for each transfer ribbon 8 may be retrieved from manufacturer databases via a communications connection 58 such as the internet. If a suitable transfer ribbon is found in the storage device 18, the controller 50 moves the storage device 18 until the suitable transfer ribbon is aligned in a transfer location which is accessible by the receiving station 12. The receiving station 12 engages the cassette 9 holding the suitable transfer ribbon. The receiving station 12 moves the cassette 9 to a starting position via the traversing unit 3.

At this point, the transfer ribbon 8 is not yet advanced toward the substrate. If the transfer ribbon is the type which can be used for several successive thermal imaging illustrations, the transfer ribbon 8 may have to be wound via the winding motors 10*a*, 10*b* within the cassette 9 to the correct position. The controller 50 detects the status of the transfer ribbon 8 and controls the positioning of the transfer ribbon 8. Now the substrate 1*a* and transfer ribbon 8 are ready for image generation.

The substrate cylinder 1 and the transfer ribbon 8 are accelerated to a reference speed and the transfer ribbon 8 is advanced toward the substrate 1*a* via the adjusting rollers 6*a*, 6*b* and means 20. After the thermal imaging illustration is completed, the transfer ribbon 8 may be wound for the next illustration cycle or any other reference position. The cassette 9 is then returned to the storage device 18.

If the controller 50 does not find a suitable transfer ribbon in the storage device 18, the controller 50 requests via the input/output device 52, a correct transfer ribbon. The user may load a cassette with the connect transfer ribbon at a transfer location in the storage device 18. Once this is accomplished, the cassette is received by the receiving device 12 and the process continues as above.

A preplanned loading of the storage device 18 by the user may be performed at any time, including simultaneously with a thermal imaging operation. In this way, if the image currently being generated is the last one possible before the cassette must be changed or if fewer than a predetermined quantity of illustrations are possible, the storage device 18 can be made ready to replace the cassette being currently used so that the time lost by the exchange of cassettes 9 is minimized.

Multicolored images are generated by performing an illustration cycle with every color with a separate transfer ribbon with the corresponding color. For example, to produce a four color image with black, cyan, magenta and yellow, each color is printed successively so the above described illustration cycle is performed four times with four transfer ribbons.

Figure 4:
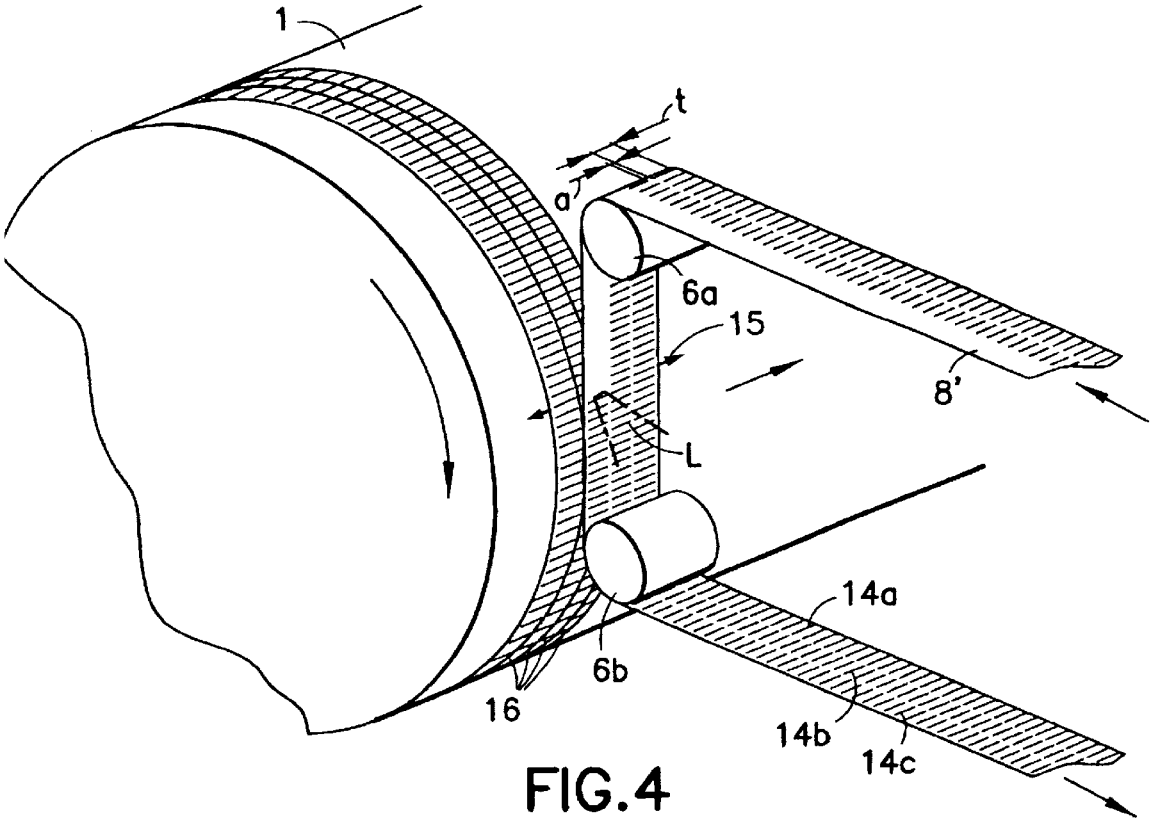
FIG. 4 shows an arrangement for multiple use of a transfer ribbon which is accommodated in a cassette.

FIG. 4 shows another possible embodiment of the present invention. Like a carbon ribbon in a conventional typewriter, the transfer ribbon 8' in FIG. 4 can not be reused at locations that have already been used, such as the darkend location on tracks 14*a*, 14*b*, and 14*c*. Multiple use of a transfer ribbon is only possible by using unused tracks. The multiple use of a ribbon such as transfer ribbon 8' of FIG. 4 is possible because the width of the transfer ribbon 8' is a multiple of an illustration width t plus a safety distance a. Thus, the transfer ribbon 8' is divided into tracks 14*a*, 14*b*, 14*c*. During the illustration cycle, one of the tracks 14*a*, 14*b*, 14*c* is available for thermal imaging. The transfer ribbon 8' is displaceable with respect to the laser beam L. The displacement direction is indicated by arrows 15.

As in the embodiments of FIGS. 1–3, the entire cassette 9 is movable by the traversing unit 3 along the entire width of the substrate cylinder 1 synchronously with the laser beam L. One of the tracks 16 is thermally imaged for each revolution of the substrate cylinder until the entire illustration surface is covered.

During the illustration cycle, the transfer ribbon 8' unwinds from the supply roll 4 and onto the takeup roll 5. After the illustration cycle is completed, the transfer ribbon 8 is wound back onto the supply roll 4 and is shifted so that an unused track is aligned with the laser L.

The controller 50 of FIG. 5 manages the tracks 14*a*, 14*b*, 14*c* and the changing of cassettes 9 where required. A large number of cassettes of the same type may be stored in the storage device to allow a large number of illustration cycles to be performed without requiring manual intervention for loading new cassettes in the storage device 18.

Furthermore, transfer ribbons may have special colors of different color scales such as the SWOP color scale, Euro scale, or any other scale having more than four colors such as Prof. Kippers seven color scale and Pantone company's six color scale. Depending on the capacity of the storage device 18, the different colors may all be available simultaneously or by exchanging cassettes.

The arrangements shown in FIGS. 1–5 is an example of many types of arrangements which can be used. For example, instead of a linear storage device, the cassettes may be mounted in a storage device having a wheel such that the transfer position for the user and with respect to the illustration and all other positions equally accessible. In addition, other arrangements such as those used in juke boxes for managing magnetic tapes and other exchangeable storage media in data processing may also be used.

The invention is not limited by the embodiments described above which are presented as examples only but can be modified in various ways within the scope of protection defined by the appended patent claims.

We claim:

1. A process for providing a thermal transfer material for thermal transfer image generation using a narrow thermal transfer ribbon, comprising the steps of:

loading a plurality of cassettes in a storage device such that each cassette is available for use in a thermal image generation arrangement, each cassette containing a thermal transfer ribbon and an information module containing information pertaining to one of identification of a type of thermal transfer ribbon therein and status of the thermal transfer ribbon therein;

reading, by a control device, the information on the information module of each of said plural cassettes and storing the information in a database;

receiving, at the control device, an externally supplied illustration command including a type of ribbon required for the thermal image generation; and managing the plural cassettes with the control device including a software program by searching, by the control device, the database to determine whether a suitable thermal transfer ribbon is stored in the storage device for implementing the illustration command, selecting a selected cassette in the storage device that includes the suitable transfer ribbon, moving the selected cassette within the storage device to align the selected cassette with a cassette receiving device arranged adjacent to said storage device, and moving the selected cassette from the storage device to the material to be printed using the cassette receiving device.

2. The process of claim 1, wherein said step of managing further comprises accessing manufacturer databases.

3. The process of claim 1, wherein said step of managing comprises managing the plural cassettes using a decentralized control device connected exclusively to a single thermal imaging printer.

4. The process of claim 1, wherein said step of reading said information comprises reading bar codes.

5. The process of claim 1, wherein said step of reading said information comprises reading an electronic chip; and said step of managing further comprises updating the information module by writing to the electronic chip.

6. The process of claim 1, wherein said step of reading comprises reading in a noncontacting manner by electromagnetic transmission.

7. A device for thermal transfer imaging, comprising:

a thermal imaging unit comprising means for effecting thermal transfer imaging;

a storage device comprising a plurality of cassettes, each said plural cassettes having a thermal transfer ribbon and an information module containing data pertaining to one of identification and status of said thermal transfer ribbon;

a cassette receiving device arranged adjacent to said storage device, wherein a selected one of said plural cassettes in said storage device is movable within said storage device into alignment with said cassette receiving device, and said cassette receiving device is operatively connected for moving said selected one of said plural cassettes aligned with said cassette receiving device from said storage device to said thermal imaging unit; and a control device including a software program operatively arranged for managing said plural cassettes, said storage device, and said cassette receiving device in response to an externally supplied thermal imaging illustration command.

8. The device of claim 7, wherein said control device comprises a database for storing data related to said plural cassettes.

9. The device of claim 7, wherein one of said thermal transfer ribbons of said plural cassettes has a width equal to a multiple of an illustration width t, such that said one of said thermal transfer ribbons is divided into several illustration tracks.

10. The device of claim 7, wherein each said plural cassettes comprises at least one takeup roll and supply roll on which said thermal transfer ribbon is wound up.

11. The device of claim 7, wherein said information module of each said plural cassettes comprises a bar code having information related to one of a status and an identification of said thermal transfer ribbon.

12. The device of claim 7, wherein said information module of each said plural cassettes comprises an electronic chip having information related to one of a status and an identification of said thermal transfer ribbon.

* * * * *